US006755622B1

(12) United States Patent
Hartnagel et al.

(10) Patent No.: US 6,755,622 B1
(45) Date of Patent: Jun. 29, 2004

(54) FUEL METERING PUMP FOR A HEATER, ESPECIALLY AN ADDITIONAL HEATER OR A PARKING HEATER OF A MOTOR VEHICLE

(75) Inventors: Rolf Hartnagel, Esslingen (DE); Wolfgang Pfister, Esslingen (DE); Thomas Görtler, Weissenhorn (DE)

(73) Assignee: J. Eberspächer GmbH & Co. KG, Esslingen (DE)

( * ) Notice: Subject to any disclaimer, the term of this patent is extended or adjusted under 35 U.S.C. 154(b) by 0 days.

(21) Appl. No.: 09/869,575

(22) PCT Filed: Dec. 2, 1999

(86) PCT No.: PCT/EP99/09430

§ 371 (c)(1),
(2), (4) Date: Sep. 6, 2001

(87) PCT Pub. No.: WO00/39460

PCT Pub. Date: Jul. 6, 2000

(30) Foreign Application Priority Data

Dec. 29, 1998 (DE) ..... 198 60 573

(51) Int. Cl.[7] ..... F04B 49/00
(52) U.S. Cl. ..... 417/42; 123/458
(58) Field of Search ..... 417/364, 415, 417/417, 307, 413.1; 123/499, 497, 533, 458; 364/510; 361/165

(56) References Cited

U.S. PATENT DOCUMENTS 3,653,787 A * 4/1972 Commarmot ..... 417/415
3,742,918 A * 7/1973 Murtin et al. ..... 123/458
3,804,558 A * 4/1974 Naito ..... 417/417
4,599,052 A * 7/1986 Langen et al. ..... 417/413.1
4,776,771 A * 10/1988 Kern ..... 417/307
4,832,583 A * 5/1989 Brown ..... 417/417
4,860,158 A * 8/1989 Brown ..... 361/165
4,994,984 A * 2/1991 Massimo ..... 364/510
5,088,902 A * 2/1992 Marioni ..... 417/415
5,207,205 A * 5/1993 Mesenich ..... 123/533
5,469,828 A * 11/1995 Heimberg et al. ..... 123/497
6,048,180 A * 4/2000 Konishi et al. ..... 417/364
6,401,696 B1 * 6/2002 Heimberg ..... 123/499

FOREIGN PATENT DOCUMENTS

DE 821 000 11/1951
DE 807 058 6/1954

* cited by examiner

*Primary Examiner*—Sang Y. Paik
*Assistant Examiner*—Leonid Fastovsky
(74) *Attorney, Agent, or Firm*—McGlew and Tuttle, P.C.

(57) ABSTRACT

A fuel metering pump (1) has a solenoid coil (2), an armature (3), a delivery piston (4) and spring-loaded valves. The spring-loaded valves are embodied as an electrically controlled suction valve (5) and an electrically controlled pressure valve (6). A solenoid coil (2) is provided for the armature (3) of the delivery piston (4), the armature (7) of the suction valve (5) and the armature of the pressure valve (6). The masses, springs and hydraulic cross-sections of the component parts are configured in such a way that the valves switch more quickly than the delivery piston moves.

20 Claims, 2 Drawing Sheets

FUEL METERING PUMP FOR A HEATER, ESPECIALLY AN ADDITIONAL HEATER OR A PARKING HEATER OF A MOTOR VEHICLE

FIELD OF THE INVENTION

The present invention pertains to a fuel feed pump for a heater, especially for an auxiliary heater or a parking heater of a motor vehicle, and in particular to a heater with a magnet coil, an armature and delivery piston as well as spring-loaded valves.

BACKGROUND OF THE INVENTION

In fuel feed pumps of the above-described class with spring-loaded pump valves, the opening and closing of the valve consequently depends on the pressure conditions in the medium being delivered. A possible admission pressure in front of the pump correspondingly affects the flow rate. The flow rate increases with increasing admission pressure. In addition, the pressure conditions in the intake line act directly on the delivery piston in current fuel feed pumps. If the pressure becomes too high, the force of the spring and the magnet is no longer sufficient to move the piston.

If the pump is equipped with "true" valves, an increasing admission pressure does not lead to a breakdown of the delivery. However, the pump is flooded because the spring-loaded pressure valves open already at very low pressures. In the case of stronger springs, the pump does not operate any longer without admission pressure, i.e., with a pressure-less feed line because the force of the magnet is no longer sufficient for opening the pressure valve.

SUMMARY AND OBJECTS OF THE INVENTION

Based on the above-mentioned problems, the primary object of the present invention is to improve a fuel feed pump of the type described in the introduction such that a satisfactorily metered delivery of the fuel medium by means of simple measures is possible largely independently from the pressure conditions in the supply or intake line of the pump.

This basic object of the present invention is accomplished by a fuel feed pump with a fluid line and a piston/cylinder unit in communication with the fluid line. The unit divides the fluid line into an intake side and a discharge side. The piston/cylinder unit includes a pump piston. An intake valve piston is arranged at the intake side of the fluid line, and a discharge valve piston is arranged at the discharge side of the fluid line. A pump piston armature is connected to the pump piston of the piston/cylinder unit, an intake armature is connected to the intake valve piston, and a discharge armature is connected to the discharge valve piston.

A common magnetic coil generates an alternating magnetic field common to the intake armature, the discharge armature and the piston armature. The intake armature, the discharge armature and the piston armature being arranged and having pumping structure to cooperate with each other and with the common alternating magnetic field to pump fluid in the fluid line from the intake side to the discharge side.

The pistons and armatures are spring loaded to move to a default or rest position when the magnetic coil is currentless.

An important feature of the present invention is that the spring-loaded valves are an electrically controlled intake valve and an electrically controlled pressure valve and that a common magnet coil is provided for the armature of the delivery piston, the armature of the intake valve and the armature of the pressure valve.

The magnet coil, the intake valve, the delivery piston with the armature and the pressure valve are preferably accommodated in a housing as one assembly unit.

The formation of vapor bubbles is prevented or minimized if a continuous fuel channel, which is connected to the piston of the intake valve, to the delivery piston and to the piston of the pressure valve, is provided in the housing in an especially advantageous variant of the present invention. The pistons of the intake and pressure valves as well as the delivery piston have circumferential seals, so that the magnet coil, the armature and the compression springs are located in a fuel-free interior space of the housing. The coil is separated from the fuel channel as a result. Due to such an arrangement of the coil, the fuel does not reach the vicinity of the heat-releasing coil windings, which helps avoid the evaporation of the fuel.

Provisions are made, in particular, for the spring-loaded intake valve to be open and the spring-loaded pressure valve to be closed by the spring force in the currentless state of the magnet coil and for the spring-loaded delivery piston to be in its withdrawn suction stroke end position or inoperative position and for the intake valve to be closed and for the pressure valve to be opened against the spring force of the intake valve upon the application of a magnet coil current and for the delivery piston to perform the delivery stroke, where the intake valve closes and the pressure valve opens more rapidly than the delivery stroke movement of the delivery piston upon the application of the magnet coil current.

The intake valve closes and the pressure valve opens preferably simultaneously upon the application of a magnet coil current.

The opening of the intake valve and the closing of the pressure valve preferably takes place more rapidly than the suction stroke movement of the delivery piston during the operation of the pump, even during interruptions of the magnet coil current, Just as in the case of the application of a magnet coil current, the opening of the intake valve and the closing of the pressure valve can also take place simultaneously during an interruption of the magnet coil current.

The above-mentioned switching operation is accomplished in terms of design by the armature of the intake valve and the armature of the pressure valve being smaller than the armature of the delivery piston and/or especially by the piston of the intake valve and the piston of the pressure valve having a smaller cross section than the delivery piston and/or especially also by the pretension of the compression spring of the intake valve and the pretension of the compression spring of the pressure valve being lower than the pretension of the compression spring of the delivery piston.

A simpler design is obtained especially by the piston of the intake valve and the piston of the pressure valve having an equal cross section and/or by the armature of the intake valve and the armature of the pressure valve having an identical design.

The intake valve, the delivery piston and the pressure valve may be arranged in series along a straight fuel channel and may especially be located at equally spaced locations from one another.

The housing preferably has a flat upper cover and is parallelepipedic, and the magnet coil is essentially also parallelepipedic with a corresponding parallelepipedic interior space for receiving the armature.

The end of the piston of the pressure valve that faces away from the armature may be accommodated in a guided manner in a hole of the housing and have especially a through hole, which is the valve opening, and releases the pressure line to the heater in an alignment or interconnection to the fuel channel.

Consequently, it is proposed according to the present invention that the pump be equipped with two controlled valves. The same magnetic force acts on these valves as on the piston. However, since the valve cross section is selected to be markedly smaller than the cross section of the piston, the valves respond more rapidly, and the valves also operate at higher pressures. If the intake valve is closed and the pressure valve is open, the delivery piston, now uncoupled from the pressure conditions in the intake line, can perform its task.

A fuel feed pump according to the present invention is consequently suitable for pressurized feed lines. The level of the admission pressure is practically irrelevant. The opening and closing of the valves depends on the force of the magnet and the spring rather than on the prevailing pressure.

However, the pump according to the present invention can also be used in pressureless feed lines, namely, "intake lines" in the direct sense of the word, because the spring force of the delivery piston brings about the suction stroke with the pressure valve closed and the intake valve open and draws the fuel from the intake or feed line as a result.

It is novel and important that the stroke of the piston and the valve actuation are carried out with the same coil. This is associated with the advantage that it is possible to reduce the number of components and thus to save costs compared with three individual components according to the state of the art (two timing valves "proper," one delivery unit). A system with a closed design can also be easily coordinated, because the pulse for the delivery stroke applies the same force to all components at exactly the same time.

Another improvement over the prior art is obtained by the fact that valve balls are no longer able to stick together, because these valve balls are eliminated altogether.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
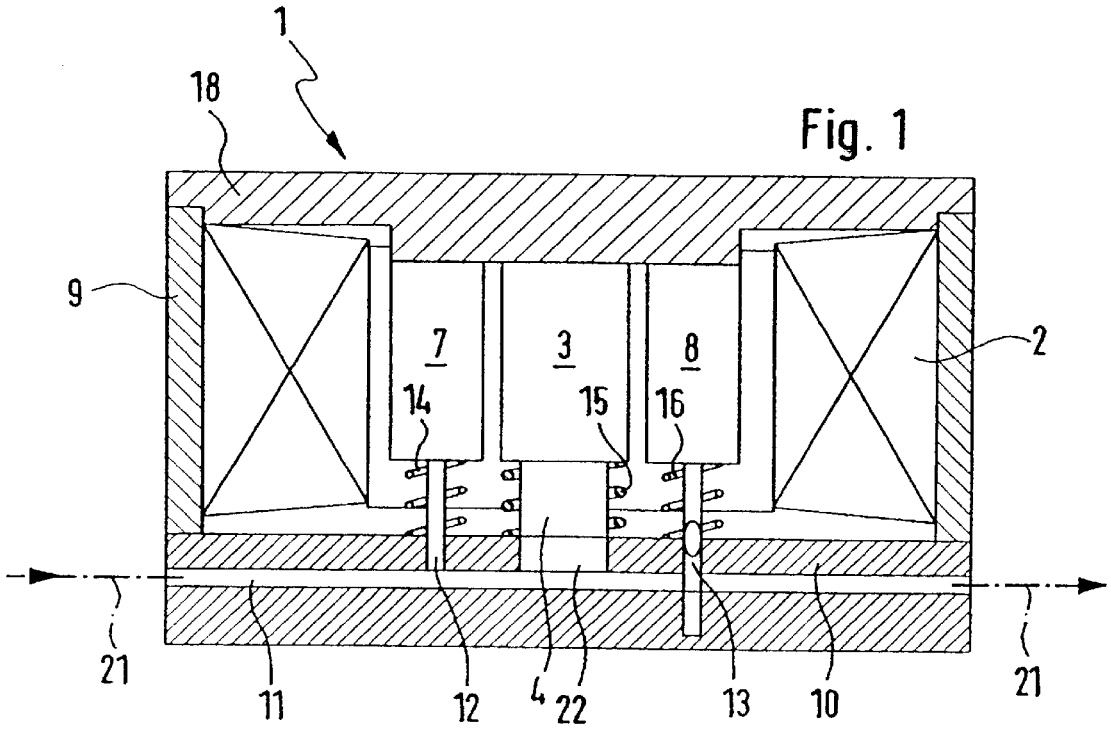
FIG. 1 is a schematic vertical section of a fuel feed pump for a heater of a motor vehicle.
Figure 2:
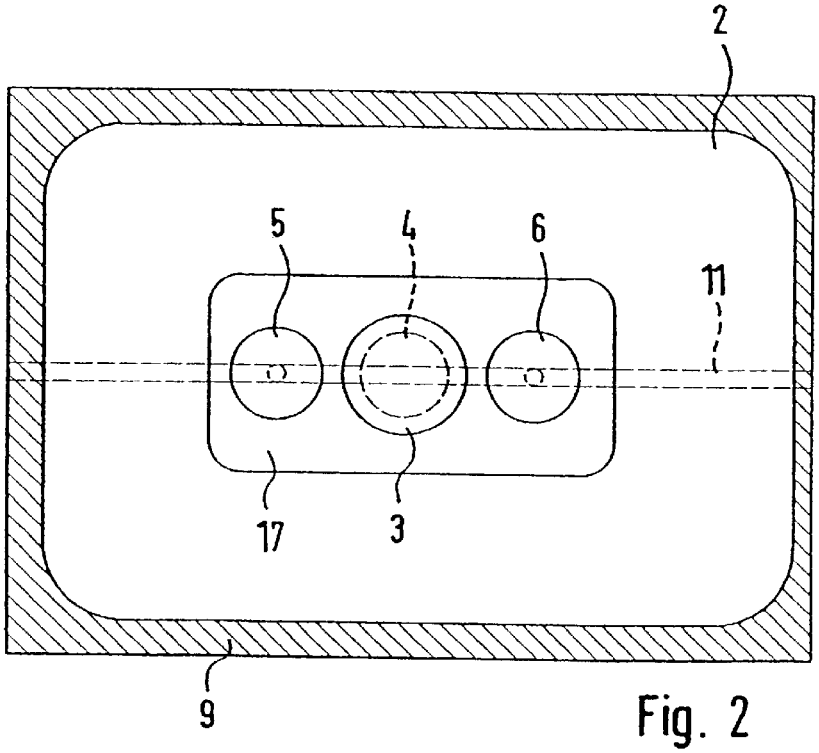
FIG. 2 is a schematic sectional top view of the fuel feed pump according to FIG. 1.

Referring to the drawings, FIG. 1 shows a fuel feed pump 1 for a heater, namely, for an auxiliary heater or a parking heater of a motor vehicle with a magnet coil 2 with a piston armature 3 and a delivery piston 4 as well as spring-loaded valves.

The fuel feed pump 1 is located in a fuel feed line 21 indicated by a dash-dotted line between a fuel tank of a motor vehicle and the heater, wherein the feed line 21 may also be laid, e.g., from a branch of a fuel feed line extending between the tank and a fuel injection engine to the heater.

The spring-loaded valves are an electrically controlled intake valve 5 and an electrically controlled pressure or discharge valve 6.

The magnet coil 2 is provided for both the armature 3 of the delivery piston 4 and intake armature 7 of the intake valve 5 and the discharge armature 8 of the pressure or discharge valve 6.

The magnet coil 2, the intake valve 5, the delivery piston 4 with the armature and the pressure valve 6 are accommodated in a housing 9 as one assembly unit.

The housing 9 has a flat upper cover 18 and has a parallelepipedic design, wherein the magnet coil 2 accommodated in the housing also has an essentially parallelepipedic shape with a corresponding parallelepipedic interior space 17 for receiving the intake and pressure valves and the delivery piston and their respective armatures 3, 7, 8.

A continuous fuel channel 11 is provided in the housing bottom 10. The continuous fuel channel 11 is connected to, or is in communication with, the piston 12 of the intake valve, the delivery piston 4 and the piston 13 of the pressure valve.

The end of the piston 13 of the pressure valve 6 which faces away from the armature 8 is accommodated in a guided manner in the housing bottom 10.

The piston 13 of the pressure valve has a through hole 20, which can be connected, or arranged, in alignment with the fuel channel 11.

The fuel feed pump 1 is arranged such that in the currentless state of the magnet coil 2, the spring-loaded intake valve is open and the spring-loaded pressure valve 6 is closed and the spring-loaded delivery piston is in its withdrawn suction stroke end position or inoperative position due to spring force. Upon application of magnetic coil current, the intake valve 5 is closed, the pressure valve 6 is opened, and the delivery piston 4 performs a delivery stroke against the force of the spring. When the magnet coil current is applied, the closing of the intake valve 5 and the opening of the pressure valve 6 take place more rapidly than the delivery stroke movement of the delivery piston 4. In particular, the closing of the intake valve 5 and the opening of the pressure valve 6 take place essentially simultaneously upon the application of the magnet coil current.

When the magnet coil current is interrupted, the opening of the intake valve 5 and the closing of the pressure valve 6 take place more rapidly than the suction stroke movement of the delivery piston 4, and the opening of the intake valve 5 and the closing of the pressure valve 6 also take place essentially simultaneously.

The above-mentioned mode of operation is established in a fuel feed pump 1 in the exemplary embodiment shown essentially by the armature 7 of the intake valve 5 and the armature 8 of the pressure valve 6 being selected to be smaller than the armature 3 of the delivery piston 4, especially by the valves to be actuated rapidly having lower weights than the delivery unit, and by the hydraulic cross sections of the piston 12 of the intake valve 5 and of the piston 13 of the pressure valve being selected to be smaller than the cross section of the delivery piston 4, and, finally, also by the pretension of the compression spring 14 of the intake valve 5 and the pretension of the compression spring 16 of the pressure valve 6 being selected to be lower than the pretension of the compression spring 15 of the delivery piston 4.

The aforementioned design measures are fine-tuned by experiments, so that a even the intake valve and the pressure valve can be ultimately fine-tuned for a given pump such that these valves will open and close simultaneously before the delivery piston feeds an appreciable amount of fuel to the heater in a metered manner with the pressure valve open and the intake valve closed or draws in fuel with the pressure valve closed and the intake valve closed or allows it to enter the pump under pressure in the case of an admission pressure. As a result, the intake valve and the pressure valve form a "lock."

According to the drawings, the piston 12 of the intake valve 5 and the piston 13 of the pressure valve 6 have an equal cross section, which is markedly smaller than the cross section of the delivery piston. The armature 7 of the intake valve 5 and the armature 8 of the pressure valve are also of identical design. The intake valve, the delivery piston and the pressure valve are arranged in series next to one another along the straight fuel channel 11 and are located at equally spaced locations from one another.

The pistons 12, 13 of the intake and pressure valves as well as the delivery piston 4 have circumferential seals, and the magnet coil 2, the armatures 3, 7, 8 and the compression springs 14, 15, 16 are located in a fuel-free interior space 17 of the housing 9.

Figure 3:
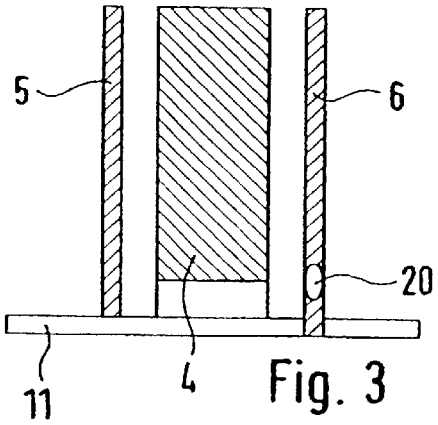
FIGS. 3 through 7 are flow charts of the fuel feed pump in four individual positions of the delivery piston and of the intake and pressure valves, wherein the end position according to FIG. 7 corresponds to the starting position according to FIG. 3.

The positions of the intake valve 5, of the delivery piston 4 and of the pressure valve 6 relative to the fuel channel 11, which positions are shown in FIGS. 3 through 7, represent:

FIG. 3: Inoperative position

The coil is currentless.

Intake valve 5 open

Pressure valve 6 closed

Delivery piston 4 in the withdrawn end position

Figure 4:
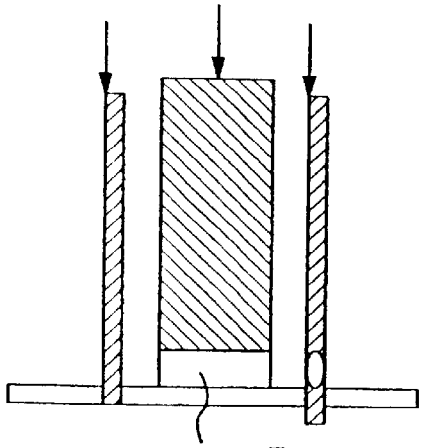

FIG. 4: Start of the delivery stroke

The coil is energized. The same magnetic force acts on all three armatures.

The pistons with the lower weight and smaller cross-sectional area are the first to start moving downward (the piston and the armature are rigidly connected to one another):

Intake valve 5 closed

Pressure valve 6 is just opened

Delivery piston 4 almost in the withdrawn end position

Figure 5:
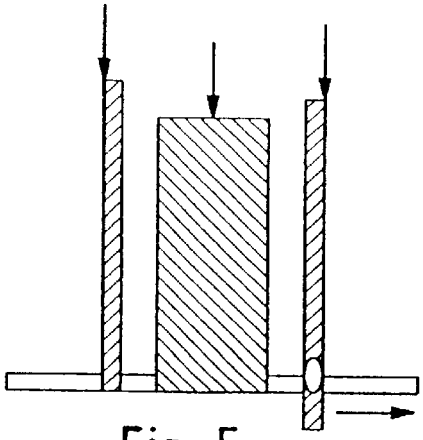

FIG. 5: End of the delivery stroke

The coil is still just energized:

Intake valve 5 closed

Pressure valve 6 open

Delivery piston 4 in the delivery stroke end position

Figure 6:
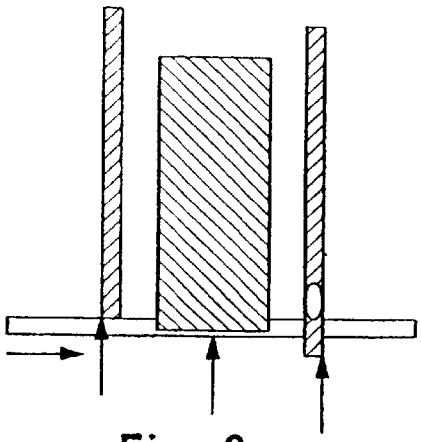

FIG. 6: Start of suction stroke

The coil is currentless just now. The piston of the intake valve and the piston of the pressure valve are pushed upward by spring force. The springs are dimensioned such that the valves open and close rapidly. The delivery piston is set into an upward movement by the spring force and/or admission pressure and draws in fuel to fill the delivery space 22:

Intake valve 5 open

Pressure valve 6 closed

Delivery piston 4 still almost in the delivery stroke end position

Figure 7:
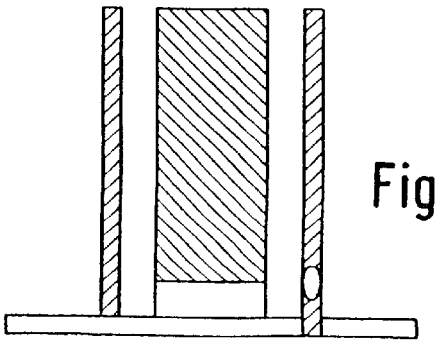

FIG. 7: End of suction stroke

This end position is the inoperative position according to FIG. 4 or the starting position for the initiation of a new delivery stroke.

It should be noted that the independently patentable features contained in the subclaims shall have a corresponding independent protection despite the formal reference made to the principal claim. All the inventive features contained in all the application documents also fall within the scope of protection of the present invention.

While specific embodiments of the invention have been shown and described in detail to illustrate the application of the principles of the invention, it will be understood that the invention may be embodied otherwise without departing from such principles.

What is claimed is:

1. A fuel feed pump for a heater of a motor vehicle, the pump comprising:

a pump piston unit for displacement of fuel with a pump piston and a pump piston armature;

an intake unit with a spring loaded intake valve piston and intake armature;

a discharge unit with a spring loaded discharge value piston and discharge armature;

a common single magnetic coil unit generatable of a magnetic field common to said piston armature, said intake armature and said discharge armature for acting simultaneously on said piston armature, said intake armature and said discharge armature and for movement of said pump piston unit, said intake valve piston and said discharge valve piston to pump fuel.

2. A fuel feed pump in accordance with claim 1, further comprising;

a housing, said magnet coil, said intake unit, said piston unit, and said discharge unit are accommodated with said common single magnet in said housing as one assembly unit.

3. A fuel feed pump in accordance with claim 2, wherein:

a continuous fuel, channel connected to said intake piston, to said discharge piston and to said pump piston is provided in said housing.

4. A fuel feed pump in accordance with claim 1, wherein said:

said intake valve unit, said discharge valve unit and said pump piston unit including springs;

said magnetic field of said magnetic coil alternates between first and second states, said first state being a currentless state of the said magnet coil, said first state of said magnet field and said springs move said intake valve unit into an open position, move said discharge valve unit into a closed position, and move said pump piston unit into a withdrawn suction stroke end position;

said second state of said magnetic field being formed by a current through said magnetic coil, said second state moves said intake valve unit into a closed position, moves said discharge valve unit into an open position and moves said pump piston unit to perform a delivery stroke against a force of said springs.

5. A fuel feed pump in accordance with claim 4, wherein:

said second state of said magnetic field moves said intake valve unit into said closed position and moves said discharge valve unit into said open position faster than said second state of said magnetic field moves said pump piston unit to perform said delivery stroke.

6. A fuel feed pump in accordance with claim 5, wherein:

said second state of said magnetic field move said intake valve unit into said closed position and moves said discharge valve unit into said open position substantially simultaneously.

7. A fuel feed pump in accordance with claim 4, wherein:

said first state of said magnetic field and said springs move said intake valve unit into said open position and move said discharge valve unit into said closed position faster than said first state of said magnetic field and said springs move said pump piston unit into said withdrawn suction stroke end position.

8. A fuel feed pump in accordance with claim 7, wherein:

said first state of said magnetic field and said springs move said intake valve unit into said open position and move said discharge valve unit into said closed position substantially simultaneously.

9. A fuel feed pump in accordance with claim 4, wherein: said intake armature of said intake valve and said discharge armature of said discharge valve are smaller than said pump piston armature.

10. A feed pump in accordance with claim 4, wherein:

a cross section of said intake valve piston and said discharge valve piston have a smaller cross section than a cross-section of said pump piston.

11. A fuel feed pump in accordance with claim 4, wherein:

a pretension of said spring of said intake valve unit and a pretension of said spring of said discharge valve unit are lower than a pretension of said spring of said pump piston unit.

12. A fuel feed pump in accordance with claim 4, wherein:

a cross section of said intake valve piston and a cross section of said discharge valve piston are substantially equal.

13. A fuel feed pump in accordance with claim 4, wherein:

said intake armature of said intake valve un and said discharge armature of said discharge valve unit are of substantially identical design.

14. A fuel feed pump in accordance with claim 3, wherein:

the fuel feed pump is substantially straight;

said intake valve piston, said discharge valve piston and said pump piston are arranged in series next to one another along said fuel channel.

15. A fuel feed pump in accordance with claim 14, said intake valve unit, said pump piston and said discharge valve unit are located at equally spaced locations from one another.

16. A fuel feed pump in accordance with claim 2, wherein:

said pistons of said intake and discharge valve units and said pump piston have circumferential seals;

said magnet coil, said armatures, and said springs are located in a said, fuel-free interior space of said housing.

17. A fuel feed pump in accordance with claim 2, wherein:

said housing has a flat upper cover, said housing has a parallelepipedic shape and said magnet coil has a substantially parallelepipedic shape with a corresponding parallelepipedic interior space for receiving said armatures.

18. A fuel feed pump in accordance with claim 3, wherein:

an end of said discharge valve piston faces away from said discharge armature and said end is accommodated in a guided manner in said housing.

19. A fuel feed pump in accordance with claim 1, wherein:

said discharge valve piston a through hole.

20. A pump comprising:

a fluid line;

a piston/cylinder unit in communication with said fluid line, said piston/cylinder unit dividing said fluid line into an intake side and a discharge side, said piston/cylinder unit including a pump piston;

an intake valve piston arranged at said intake side of said fluid line;

a discharge valve piston arranged at said discharge side of said fluid line;

a pump piston armature connected to said pump piston of said piston/cylinder unit;

an intake armature connected to said intake valve piston;

a discharge armature connected to said discharge valve piston;

a common single magnetic coil unit for generating an alternating magnetic field common to said intake armature, said discharge armature and said piston armature and acting at the same time on said intake armature, said discharge armature and said piston armature; said intake armature, said discharge armature and said piston armature being a ranged and having pumping structure to cooperate with each other and with said common alternating magnetic field to pump fluid in said fluid line from said intake side to said discharge side.

* * * * *